United States Patent [19]

Ito

[11] Patent Number: 5,012,573

[45] Date of Patent: May 7, 1991

[54] BUTTON APPLICATOR

[75] Inventor: Kazuyoshi Ito, Toyama, Japan

[73] Assignee: Yoshida Kogyo K.K., Japan

[21] Appl. No.: 532,654

[22] Filed: Jun. 4, 1990

[30] Foreign Application Priority Data

Jun. 5, 1989 [JP] Japan ..... 1-142589

[51] Int. Cl.[5] ..... B23P 19/00

[52] U.S. Cl. ..... 29/798; 29/432

[58] Field of Search ..... 29/798, 432; 227/31-36, 61, 154

[56] References Cited

U.S. PATENT DOCUMENTS

Re. 31,737 11/1984 Hafner ..... 29/798 X 3,699,626 10/1972 Roth ..... 29/798 X

*Primary Examiner*—Timothy V. Eley

*Assistant Examiner*—R. Martin

*Attorney, Agent, or Firm*—Hill, Van Santen, Steadman & Simpson

[57] ABSTRACT

A button applicator for caulking one button element to another button element through a fabric piece, using a punch and a die. When a button element having a different caulking pressure is applied, any adjusting for a resilient force supporting the die is unnecessary. According to a preferred embodiment, a first spring and a second spring are provided between a spring-positioning member and a spring-supporting member so that the first spring is encircled by the second spring and that the top of the first spring is higher than the top of the second spring by a predetermined gap. The movement of the die is conveyed to the springs through a shaft provided between the die and the spring-positioning member. The button element, which has a smaller caulking pressure, is caulked by a resilient force of the first spring. Then, the button element, which has a larger caulking pressure, is caulked by a resilient force of the both springs, after the first spring is compressed to be deformed with a displacement of the gap.

9 Claims, 5 Drawing Sheets

BUTTON APPLICATOR

BACKGROUND OF THE INVENTION

1. Field of the Invention

The present invention relates to a button applicator for attaching a pair of button elements such as a combination of a button body and a tack member, a combination of a hook and an eye and the like to a fabric piece by caulking one button element to another button element through the fabric piece, more particularly related to a button applicator, which does not require any adjusting for a resilient force supporting the die, when a button element having different caulking pressure is applied.

2. Prior Art

In order that one button element is caulked to another button element through a fabric piece, usually, a button applicator using a punch and a die is applied. In this case, a press-stroke should be adjusted corresponding to the thickness of the fabric piece by adjusting a stroke with which the punch is brought down or by adjusting a position of the die. If the adjusting operation is not carried out, following problems are caused;

If a fabric piece is changed to a thicker fabric piece in caulking operation without the adjusting of the press-stroke, an exceeding pressure causes damage to the thicker fabric piece and/or to the caulked button elements, for example, the fabric piece is rent.

On the other hand, if the following fabric piece is thinner than the previous one, an insufficient pressure causes unsuitable caulking conditions.

However, it is troublesome that the press-stroke should be changed every time when the thickness of the fabric piece is changed.

In order to solve this problem, apparatuses, which are shown in Japanese patent application No. 41-7905 and Japanese Utility Model Application No. 57-121620, were proposed;

According to this prior art, a spring is provided under a die. An exceeding pressure, which is produced when a fabric piece is changed to another thicker fabric piece, is absorbed by the spring. Therefore, in caulking operation, the fabric piece, which has many kinds of thickness, can be used without the adjusting of the press-stroke.

However, in the apparatus of Japanese patent application No. 41-7905, the resilient force of the spring should be adjusted every time another button element, which has different caulking pressure, is caulked. Since, this adjusting operation is very troublesome, it takes a long time to caulk the button elements using this apparatus.

In order to solve this problem, according to the apparatus of Japanese Utility Model Application No. 57-121620, an adjusting plate, which has a predetermined thickness corresponding to the caulking pressure of each button element, is selected to be inserted under the spring.

However, it is also troublesome to change the adjusting-plate every time when another button element is caulked. As a result, the caulking operation using this apparatus can not be carried out efficiently.

SUMMARY OF THE INVENTION

It is therefore an object of the present invention to provide a button applicator for caulking one button element to another button element through a fabric piece and which does not require any operation or any means such as an adjusting plate for adjusting a resilient force supporting the die, when a button element having different caulking pressure is applied.

According to the button applicator of the present invention, one button element is caulked to another button element through a fabric piece with a punch, which is brought down for a predetermined stroke, and a die. The die is supported upward by a resilient force. A pressure, which is produced by being brought down of the punch, is applied to the die. While the applied pressure increases to a predetermined caulking pressure, the die stands for the pressure. However, when the applied pressure exceeds the predetermined caulking pressure, the die begins to be brought down. The lower part of the die is interconnected with a shaft, which is inserted through a spring-positioning member. A spring-supporting member is moved in combination with the shaft and locates apart from the spring-positioning member with a desired length. A first spring and a second spring are provided between the spring-positioning member and the spring-supporting member. When the applied pressure to the die exceeds the predetermined caulking pressure, the first spring is compressed to be deformed with a displacement of a predetermined gap. In this case, the resilient force supporting the die is shifted from a resilient force of the first spring, corresponding to the predetermined caulking pressure, to a resilient force related to the both springs, corresponding to a predetermined larger caulking pressure. This shifting is carried out by a means for automatically shifting a supporting force through the shaft.

According to the button applicator of the present invention, the button element, which has the smaller caulking pressure, is caulked by the resilient force of the first spring. Then, the button element, which has the predetermined larger caulking pressure, is caulked by the resilient force related to the both springs.

Further objects and advantages of the present invention will be apparent from the following description, reference being had to the accompanying drawing wherein preferred embodiments of the present invention are clearly shown.

DESCRIPTION OF THE PREFERRED EMBODIMENT

Figure 1:
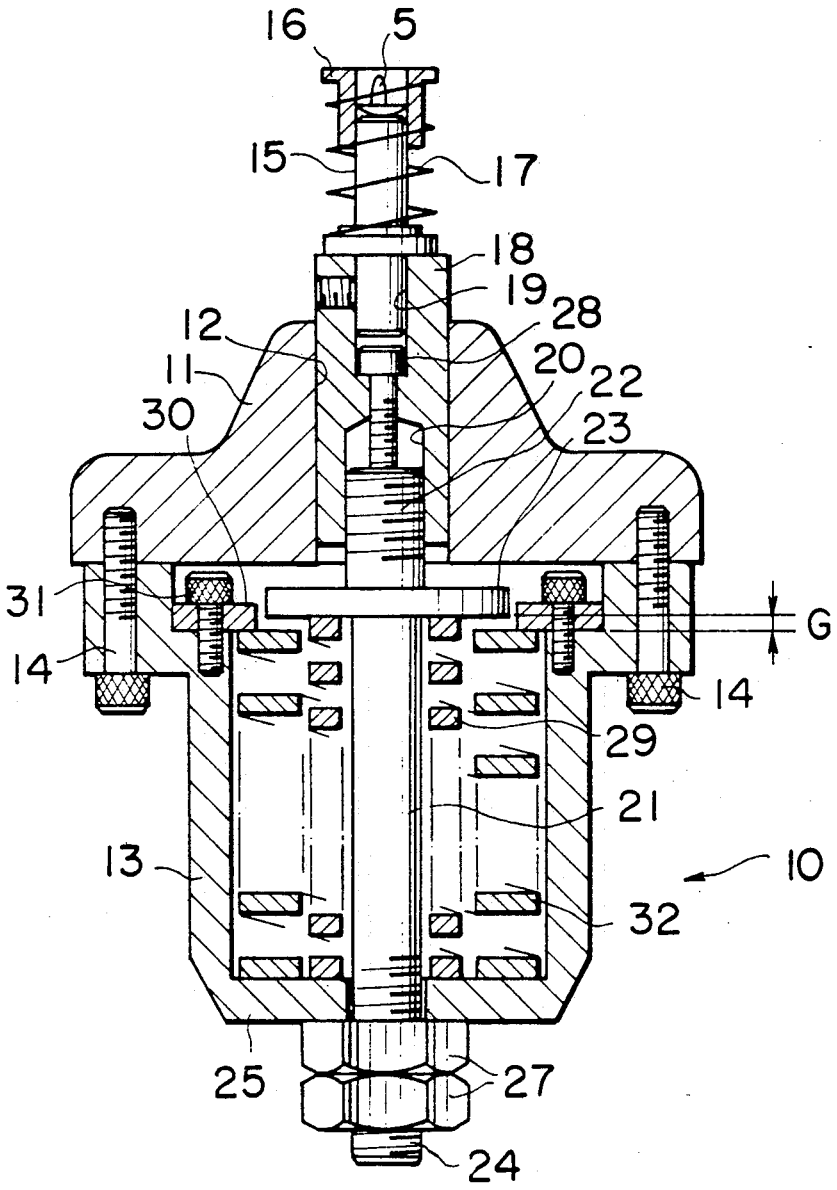
FIG. 1 is a cross section showing the apparatus of the first embodiment related to the present invention.

Now, the present invention is described more particularly by way of the embodiments shown in the drawings.

Figure 2:
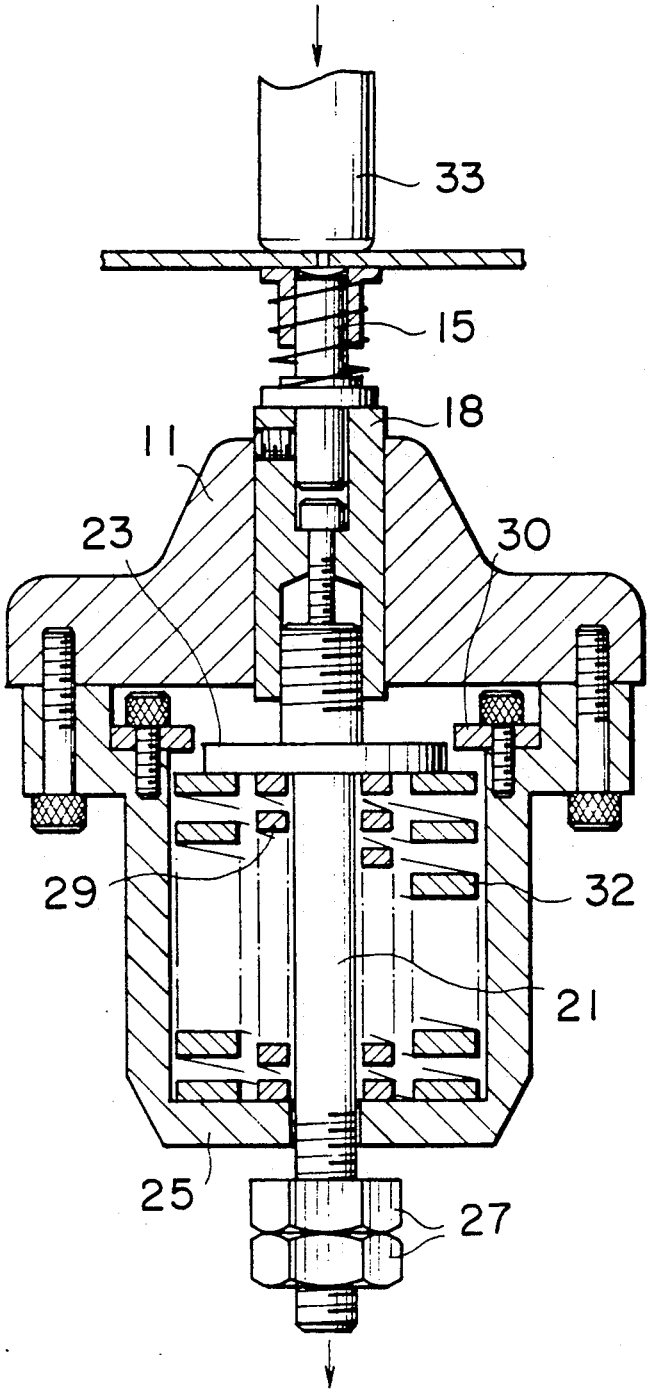
FIG. 2 is a cross section showing operation in FIG. 1.

The first embodiment of an apparatus 10 of the present invention is shown in FIGS. 1 and 2.

A block-shaped body 11 has a through-hole 12 at its center. A box-shaped casing 13 is fixed to the body 11 with bolts 14, 14 screwed into an upper stepped portion of the casing 13. The top of the casing 13 is totally opened to be covered with the body 11.

A die 15 supports a cylindrical holder 16, which supports one button element 5 with a spring 17 so that the holder 16 slides upward and downward along the die 15. The die 15 is fixed to a connecting member 18, while the lower portion of the die 15 is engaged in an upper recess 19 of the connecting member 18. The connecting member 18 is inserted in the through-hole 12 of the body 11 so as to slide upward and downward. An upper screw portion 22 of a shaft 21 is screwed coaxially into a screw-hole 20, which is formed at the lower portion of the connecting member 18. The shaft 21 is provided with a flange 23 below the upper screw portion 22. The shaft 21 has also a lower screw portion 24, which is projected out from the casing 13 through a through-hole 26 of a bottom 25 of the casing 13. The shaft 21 is inserted through the bottom 25 and slidably fixed to the casing 13 with double nuts 27. A bolt 28 is provided between the upper recess 19 and the screwhole 20 in the connecting member 18 in order to adjust the position of the die 15. The fore end of the bolt 28 is screwed into the top of the shaft 21. The position of the die 15 is adjusted by a following method;

At first, the bolt 28 is loosened so that the connecting member 18 is allowed to rotate about the shaft 21. By so doing, the shaft 21 can be moved downward and upward. When the shaft 21 is moved to a desired position, a distance between the die 15 and the bolt 28 becomes a desired length. Then, the bolt 28 is tightened in order to fix the shaft 21. As a result, the desired position of the die 15 in relation to the position of the shaft 21 can be obtained.

A first spring 29 is provided between the flange 23 as a spring-supporting member and the bottom 25 as a spring-positioning member. A spring washer 30 is fixed on the inner horizontal face of the stepped portion of the casing 13 with bolts 31, 31. A second spring 32 are provided between the washer 30 and the bottom 25 to encircle the first spring 29. It does not matter whether the resilient forces of the both springs 29, 32, are same or different.

The shaft 21 is always urged resiliently upward by the first spring 29. A gap G is formed between the underside of the flange 23 and the top of the second spring 32. In other wards, the top of the first spring 29 is higher than the top of the second spring 32 by the gap G, which can be adjusted by the double nuts 27.

Now, operation of the first embodiment will be described.

One button element 5 placed on the die 15 is caulked to another button element (not shown) through a fabric piece.

The button element 5, which has a smaller caulking pressure, is caulked in a following process;

First, a punch 33 is brought down to pressure the die 15 downward. The die 15 stands for an applied pressure produced by the being brought down of the punch 33 while the applied pressure increases the predetermined smaller caulking pressure. However, when the applied pressure exceeds this predetermined pressure, the die 15 begins to be brought down. As so doing, the shaft 21 is brought down to compress the first spring 29 through the flange 23. Accordingly, the die 15 is supported by the resilient force of the first spring 29. As a result, the button element 5, which has the smaller caulking pressure. is caulked by the resilient force of the first spring 29 compressed to be deformed within the gap G.

On the other hand, the button element 5, which has a larger caulking pressure, can not be caulked by the resilient force of only the first spring 29. This button element 5 is caulked in a following method;

Comparing the operation of the above mentioned case, the die 15 is further brought down, thus, the shaft 21 is further brought down through the connecting member 18. Accordingly, as shown in FIG. 2, the flange 23 of the shaft 21 is brought down to contact with the second spring 32, after the first spring 29 is compressed to be deformed with a displacement of the gap G. Then, the resilient force of the first spring 29 together with the resilient force of the second spring 32 can be obtained. Accordingly, the die 15 is supported by the resilient force of the both springs 29, 32. Therefore, this button element 5, which has the larger caulking pressure, is caulked by the total resilient force of the both springs 29, 32.

In this case, as a means for automatically shifting the supporting force, the relational arrangement of the both springs 29, 32 as mentioned hereinbefore is necessary; the first spring 29 is encircled by the second spring 32 and the position of the top of the first spring 29 is higher than the position of the top of the second spring 32 by the gap G.

As a result, according to the first embodiment, when another button element, whose caulking pressure is different to that of the previous button element, is caulked, any adjusting operation is unnecessary due to the means for automatically shifting the supporting force.

Figure 3:
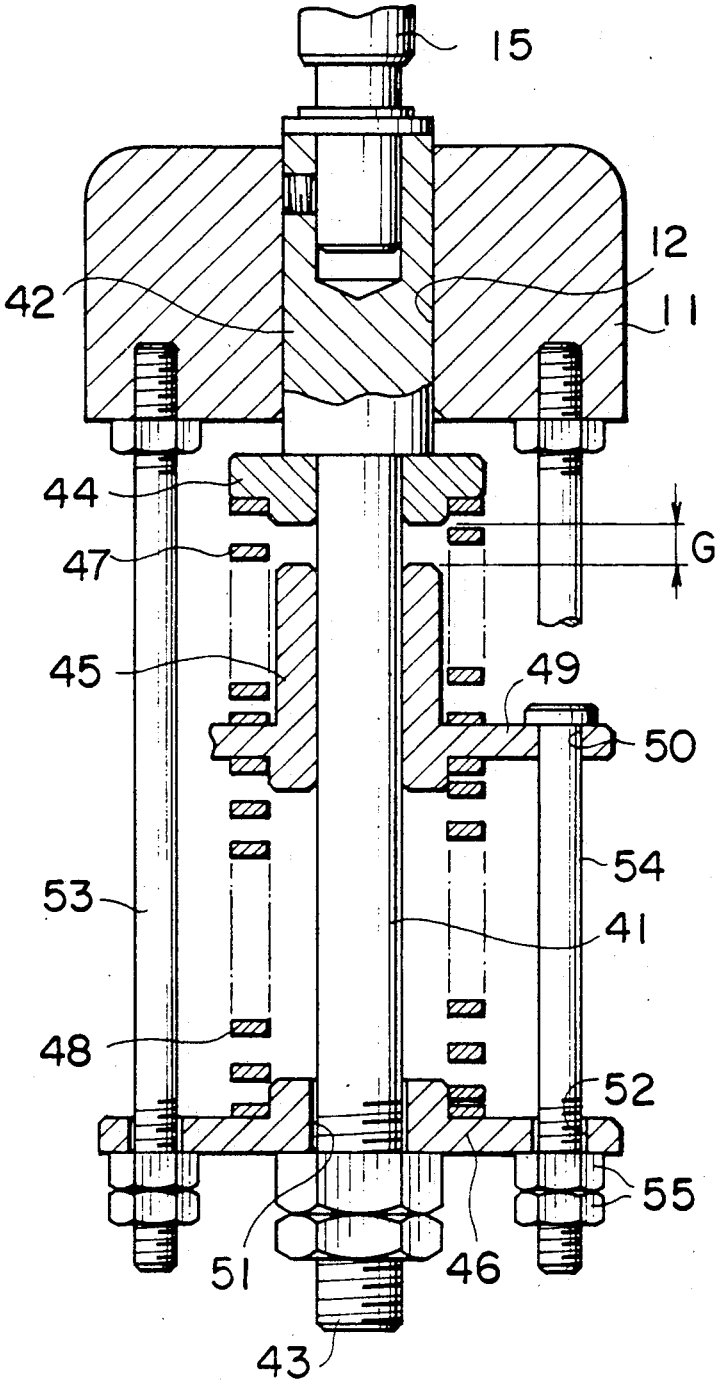
FIG. 3 is a cross section showing the apparatus of the second embodiment.

The second embodiment is shown in FIG. 3. According to this embodiment, a first spring 47 and a second spring 48 are placed to be arranged longitudinally in a series. A head 42, whose diameter is larger than that of a shaft 41, is provided at the upper end of the shaft 41. A screw portion 43 is formed at the lower end of the shaft 41. The head 42 is inserted into a through-hole 12 of a body 11 so as to slide upward and downward. A die 15 is removably fixed to the head 42. A spring washer 44, which serves as the spring-supporting member, is fixed to the underside of the head 42. An intermediate member 45 is provided at the substantial center of this apparatus. The first spring 47 is provided between the washer 44 and the intermediate member 45. A lower member 46 as the spring-positioning member is provided at the lower part of this apparatus. The lower member 46 has a through-hole 51, whose diameter is slightly larger than that of the shaft 41. The screw portion 43 of the shaft 41 is inserted through the through-hole 51 so that the shaft 41 is slidably fixed to the lower member 46 with double nuts 27. The second spring 48 is provided between the intermediate member 45 and the lower member 46. The resilient force of the first spring 47 is smaller than that of the second spring 48. The intermediate member 45 is a cylindrical member, through which the shaft 41 is slidably inserted. The intermediate member 45 is provided with a flange 49, on which a number of holes 50, 50 are circumferentially formed. A number of holes 52, 52 are formed on the lower member 46 to encircle the through-hole 51. A number of screw-holes are also formed on the underside of the body 11. The holes 52, 52 of the lower member 46 face frontally the holes 50, 50 of the intermediate member 45 or the screw-holes of the body 11 respectively. Supporting rods 53, 53 support the lower member 46, while their upper ends are screwed into the screw-holes of the body 11 and their lower ends are slidably inserted through the holes 52, 52 of the lower member 46. Intermediate rods 54, 54 support the intermediate member 45, while their upper ends are inserted in the holes 50, 50 of the flange 49 and their lower ends are slidably inserted through the holes 52, 52 of the lower member 46. Adjusting nuts 55, 55 are provided at the intermediate rods 54, 54 under the lower member 46 so as to adjust the length of a gap G between the washer 44 and the top of the intermediate member 45. Although, the intermediate rods 54, 54 are firmly fixed to the flange 49 of the intermediate member 45 in FIG. 3, they may be slidably inserted through the flange 49.

Now, operation using the apparatus of the second embodiment is described.

In this operation, the button element, which has a smaller caulking pressure, is caulked as follows;

Since the resilient force of the first spring 47 is smaller than that of the second spring 48, the second spring 48 is not compressed under an applied pressure within the predetermined caulking pressure. Then, the die 15 is supported by resilient force of the first spring 47. As a result, the button element, which has the smaller button caulking pressure, is caulked by the resilient force of the first spring 47 compressed to be deformed within t! ≥ g_p G.

Then, the button element, which has a larger caulking pressure, is caulked as follows;

Comparing the operation in the above mentioned case, the shaft 41 is further brought down against the resilient force of the first spring 47. Thus, the washer 44 is also brought down to contact with the intermediate member 45. That is to say, the gap G is disappeared, after the first spring 47 is compressed to be deformed with a displacement of the gap G. Accordingly, the first spring 47 is prevented from being compressed any more. Then, the die 15 is supported by the resilient force of the second spring 48. As a result, the button element, which has the larger caulking pressure, is caulked by the resilient force of the second spring 48.

That is to say, for example, given the resilient force of the first spring 47 of 300 kg and that of the second spring 48 of 600 kg, a button element, which has a caulking pressure of 300 kg and another button element, which has that of 600 kg, can be caulked without any adjusting.

Figure 4:
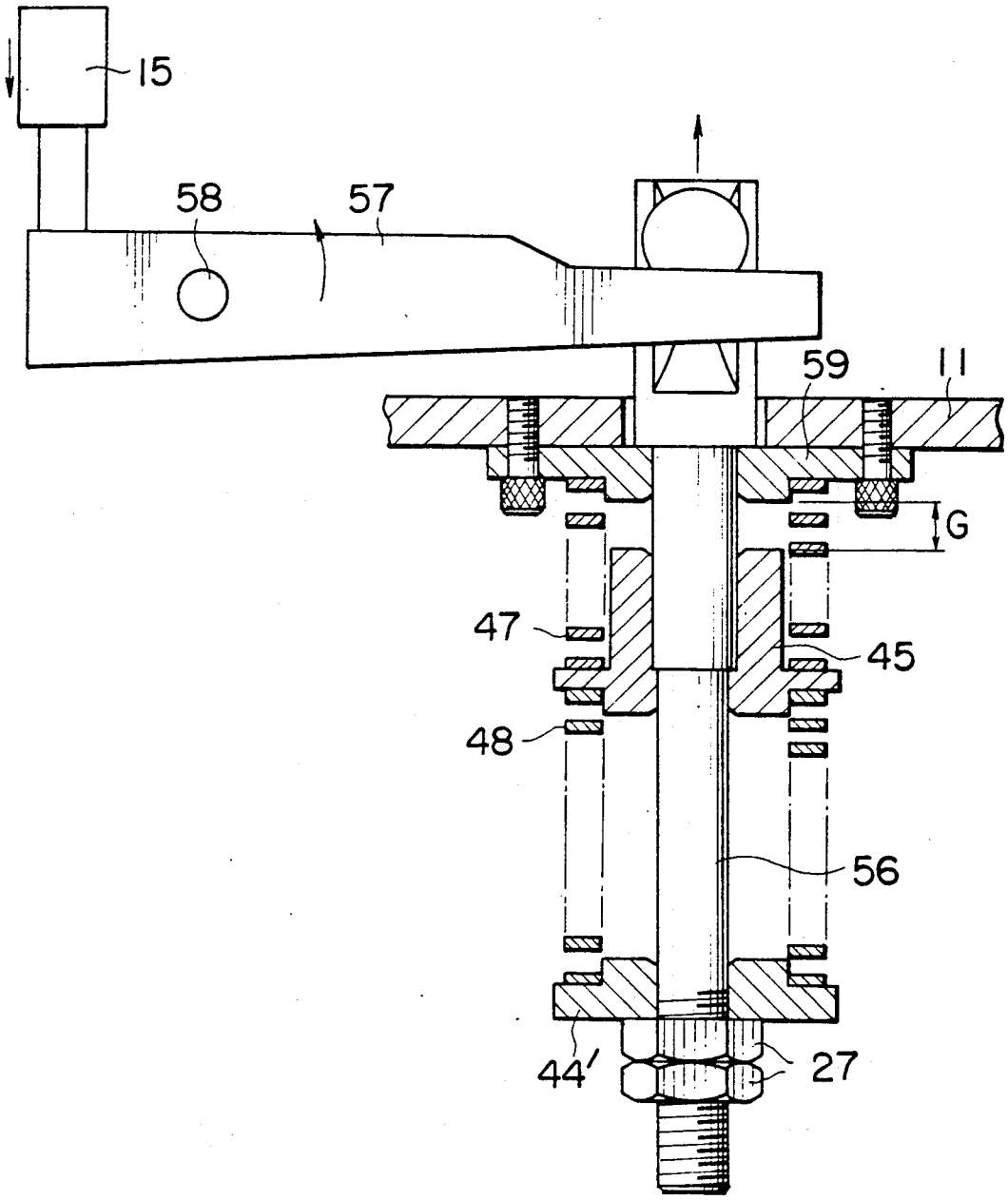
FIG. 4 is a cross section showing the apparatus of the third embodiment.

The third embodiment is shown in FIG. 4. The lower end of a die 15 is interconnected with the upper end of a shaft 56 through the intermediary of a swing lever 57. Accordingly, when the die 15 is pressured, the swing lever 57 is allowed to swing about a pin 58 as an intermediate pivoted point to lift the shaft 56. A spring washer 59 as the spring-positioning member is fixed to a body 11. The shaft 56 is slidably inserted through an intermediate member 45 and is also inserted through a lower member 44' as the spring-supporting member so as to be slidably fixed to it with double nuts 27. A first spring 47 is provided between the washer 59 and the intermediate member 45. A second spring 48 is provided between the intermediate member 45 and the lower member 44'. That is to say, the both springs 47, 48 are arranged to be placed in a series longitudinally through the intermediate member 45.

The button element, which has a smaller caulking pressure, is caulked as follows;

When the die 15 is pressured, the shaft 56 is lifted through the intermediary of the swing lever 57. Since the resilient force (for example, 300 kg) of the first spring 47 is smaller than the resilient force (for example, 600 kg) of the second spring 48, the second spring 48 is not compressed under an applied pressure within the predetermined caulking pressure. Accordingly, when the first spring 47 is compressed to be deformed within a gap G through the second spring 48 and the intermediate member 45, the button element, which has the smaller caulking pressure (300 kg), is caulked by the resilient force (300 kg) of the first spring 47.

Then, the button element, which has a larger caulking pressure, is caulked as follows;

Comparing the operation in the above mentioned case, the shaft 56 is further lifted. The intermediate member 45 is also lifted to contact with the washer 59. That is to say, the gap G is disappeared, after the first spring 47 is compressed to be deformed with a displacement of the gap G. Accordingly, the first spring 47 is prevented from being compressed any more. Then, the die 15 is supported by the resilient force of the second spring 48. As a result, the button element, which has the larger caulking pressure (600 kg), is caulked by the resilient force (600 kg) of the second spring 48.

Figure 5:
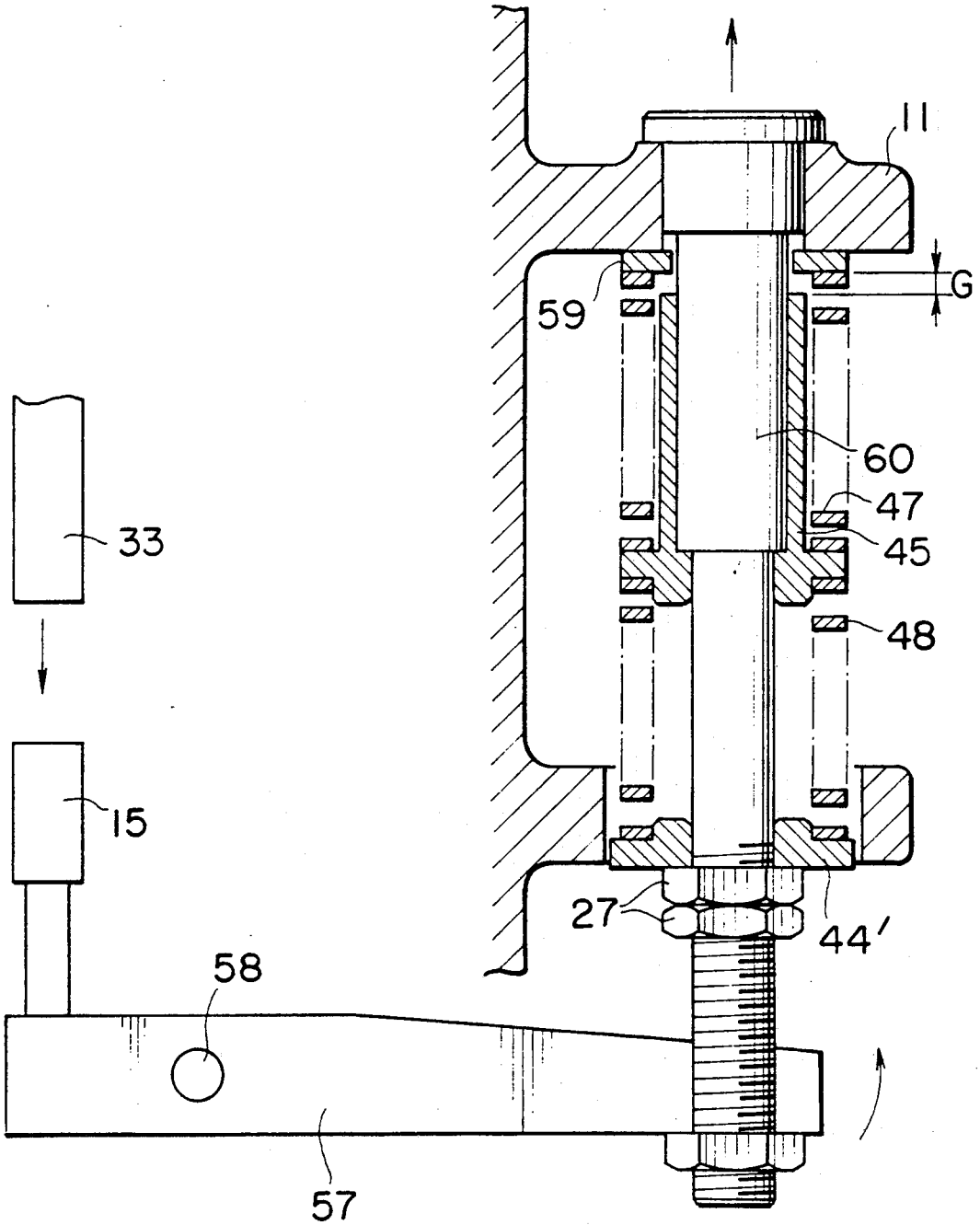
FIG. 5 is a cross section showing the apparatus of the forth embodiment, which is a modification of the third embodiment in FIG. 4.

The forth embodiment is shown in FIG. 5. This embodiment is a modification of the third embodiment. According to this apparatus, a swing lever 57 is fixed to the lower end of a shaft 60. A first spring 47 is provided between a spring washer 59 as the spring-supporting member and an intermediate member 45. A second spring 48 is provided between the intermediate member 45 and a lower member 44' as the spring-supporting member. The shaft 60 is inserted through the lower member 44' and is slidably fixed to it with double nuts 27.

The button element, which has a smaller caulking pressure, is caulked as follows;

When a die 15 is pressured by a punch 33, the shaft 60 is lifted through the intermediary of the swing lever 57, which pivots about a pin 58 as the intermediate pivoted point. Since the resilient force (for example, 300 kg) of the first spring 47 is smaller than the resilient force (for example, 600 kg) of the second spring 48, the second spring 48 is not compressed to be deformed under an applied pressure within the predetermined caulking pressure. Then, the button element, which has the smaller caulking pressure (300 kg), is caulked by the resilient force (300 kg) of only the first spring 47 compressed to be deformed within a gap G.

Then, the button element, which has a larger caulking pressure, is caulked as follows;

Comparing the operation in the above mentioned case, the shaft 60 is further lifted. The intermediate member 45 is also lifted to contact with the spring washer 59. Accordingly, after the first spring 47 is compressed to be deformed with a displacement of the gap G, the first spring 47 is prevented from being compressed any more. Therefore, the die 15 is supported by the resilient force of the second spring 48. Accordingly, the button element, which has the larger caulking pressure (600 kg), is caulked by the resilient force (600 kg) of the second spring 48.

As a result, when another button element, whose caulking pressure (for example 600 kg) is different from that (for example 300 kg) of the previous button element, is caulked, any adjustment is unnecessary with these apparatus of the third and forth embodiments, similarly to the first and second embodiments.

In the second, third, forth embodiments, as the means for automatically shifting the supporting force, the above mentioned conditions related to the both springs 47, 48 are necessary; the resilient force of the first spring 47 is smaller than that of the second spring 48, the both springs 47, 48 are placed longitudinally in a series and the displacement of the first spring 47 is limited in the gap G.

While preferred embodiments have been described, it is apparent that the present invention is not limited to the specific embodiments thereof.

What is claimed is:

1. A button applicator for caulking one button element to another button element through a fabric piece, comprising:

a punch which is brought down for a predetermined stroke;

a die which is supported upwardly by a resilient force and to which a pressure is applied by pressing down thereon by said punch displacing said die downwardly against the resilient force;

a spring-positioning member;

a shaft having one end interconnected with a lower part of said die and which is inserted through said spring-positioning member;

a spring-supporting member which is interconnected to and moved in combination with said shaft and which is urged apart from said spring-positioning member by said resilient force;

a first spring and a second spring which are provided between said spring-positioning member and said spring-supporting member, and said resilient force is created alternately by said first spring and said first and second spring in combination pressing against said spring-supporting member as the die is displaced downwardly;

a means for automatically shifting said resilient force from a resilient force created by said first spring, corresponding to a predetermined smaller caulking pressure, to a resilient force created by said first spring and said second spring, corresponding to a predetermined larger caulking pressure, when said pressure applied to said die exceeds said predetermined smaller caulking pressure and said first spring is compressed to be deformed with a displacement of a predetermined gap.

2. A button applicator according to claim 1, wherein said means for automatically shifting said resilient force is the diameter of said first spring being different from the diameter of said second spring, said first and second springs being provided coaxially and before said pressure is applied, the position of the top of said first spring being closer to said spring-supporting member, than the position of the top of said second spring by said gap, said first spring compressed by said gap before said second spring is compressed by said spring-supporting member.

3. A button applicator according to claim 1, wherein the upper end of said shaft is connected to said lower part of said die.

4. A button applicator according to claim 1, wherein said die is interconnected with said shaft through the intermediary of a lever which swings abou: an intermediate pivoted point of said lever.

5. A button applicator for caulking one button element to another button element through a fabric piece, comprising:

a punch which is brought down for a predetermined stroke;

a die which is supported upwardly by a resilient force and to which a pressure is applied by pressing down thereon by said punch displacing said die downwardly against the resilient force;

a spring-positioning member;

a shaft having one end interconnected with a lower part of said die and which is inserted through said spring-positioning member;

a spring-supporting member which is interconnected to and moved in combination with said shaft and which is urged apart from said spring-positioning member by said resilient force;

a first spring and a second spring which are provided between said spring-positioning member and said spring-supporting member, and said resilient force is created alternately by said first spring and said second spring pressing against said spring-supporting member, as the die is displaced downwardly;

a means for automatically shifting said resilient force from a resilient force created by said first spring, corresponding to a predetermined smaller caulking pressure, to a resilient force created by said second spring, corresponding to a predetermined larger caulking pressure, when said pressure applied to said die exceeds said predetermined smaller caulking pressure and said first spring is compressed to be deformed with a displacement of a predetermined gap.

6. A button applicator according to claim 5, wherein said means for automatically shifting said resilient force is an arrangement where said resilient force of said first spring is selected smaller than said resilient force of said second spring, said both springs being placed longitudinally in series and said displacement of said first spring is limited to said gap.

7. A button applicator according to claim 6, wherein said means for automatically shifting comprises an intermediate member arranged mounted slidably on said shaft in a longitudinal direction, said intermediate member arranged above a top of said second spring, said intermediate member arranged below said spring supporting member, and before said pressure is applied, said intermediate member and said spring-supporting member separated by said predetermined gap, said first spring arranged between said intermediate member and said spring-supporting member urging said spring-supporting member apart from said intermediate member, applying pressure causes said first spring to compress until said predetermined gap is closed and thereupon said spring-supporting member abuts said intermediate member, and further displacement of said die downwardly compresses said second spring.

8. A button applicator according to claim 5, wherein an upper end of said shaft is connected to said lower part of said die.

9. A button applicator according to claim 5, wherein said die is interconnected with said shaft through the intermediary of a lever which swings about an intermediate pivoted point of said lever.

* * * * *